US006079072A

United States Patent [19]

Katsiri

[11] Patent Number: 6,079,072

[45] **Date of Patent: *Jun. 27, 2000**

[54] FOLDABLE AND RIGIDIZABLE SPACE SPANNING STRUCTURE

[75] Inventor: Elli Katsiri, Bayside, N.Y.

[73] Assignee: Philip Furgang, Suffer, N.Y.

[ * ] Notice: This patent is subject to a terminal disclaimer.

[21] Appl. No.: 08/456,880

[22] Filed: Jun. 1, 1995

Related U.S. Application Data

[62] Division of application No. 08/157,441, Nov. 26, 1993, which is a continuation of application No. 07/309,609, Feb. 18, 1989, which is a continuation-in-part of application No. 07/252,821, Sep. 30, 1988.

[51] Int. Cl.[7] ..... E01D 15/12

[52] U.S. Cl. ..... 14/2.4; 14/69.5; 52/282.1; 52/281; 52/588.1; 182/104; 182/156; 182/163; 414/537; 414/921

[58] Field of Search ..... 14/2.4, 69.5; 52/282.1, 52/281, 588.1; 160/135, 229.1; 182/104, 156, 163; 414/537, 921

[56] References Cited

U.S. PATENT DOCUMENTS

| | | | |
|---|---|---|---|
| 2,203,193 | 6/1940 | Ettinger | 5/82 R |
| 2,226,307 | 12/1940 | Ettinger | 5/82 R |
| 2,335,140 | 11/1943 | Bell | 5/82 R |
| 2,889,561 | 6/1959 | Martin | 5/110 |
| 3,707,734 | 1/1973 | Matthews | 5/82 |
| 3,882,557 | 5/1975 | Stehlik | 5/114 |
| 3,886,606 | 6/1975 | Bradford | 5/82 R |
| 4,147,198 | 4/1979 | Ytter | 160/229.1 |
| 4,584,729 | 4/1986 | Roberts et al. | 5/82 R |
| 4,685,161 | 8/1987 | Zalman | 5/82 R |
| 4,700,416 | 10/1987 | Johansson | 5/82 R |
| 4,891,851 | 1/1990 | Sierocuk et al. | 5/82 R |

*Primary Examiner*—Henry A. Bennett
*Assistant Examiner*—Pamela A. O'Connor
*Attorney, Agent, or Firm*—Furgang & Adwar LLP

[57] ABSTRACT

A frame assembly supports a work surface of either flexible material or of sections of foldable and unfoldable relatively rigid material all so that the frame assembly and material may either be unfoldable and rigidized or folded into a compact package. The flexible frame assembly includes a pair of spaced poles and a number of hinged sections aligned so that the poles and material can be folded in sections. The poles rotate to permit either a frame folded disposition or a frame rigidized disposition. Embodiments include stretchers, screens and enclosures. The rigid material assembly provides a collapsible and rigidizable space spanning structure formed with a number of hinged sections of center supports and plates hingedly connected together to be either folded into a relatively compact device or unfolded and hingedly positioned to form rigidized space spanning structures.

12 Claims, 9 Drawing Sheets

FOLDABLE AND RIGIDIZABLE SPACE SPANNING STRUCTURE

This is a divisional of copending application Ser. No. 08/157,441 filed on Nov. 26, 1993, which is a continuation of copending application Ser. No. 07/309,609 filed on Feb. 18, 1989, which is a continuation-in-part of copending application Ser. No. 07/252,821 filed on Sep. 30, 1988.

BACKGROUND OF THE INVENTION—FIELD OF APPLICATION

This invention relates to devices which can be placed in either a relatively rigidized condition or a folded or collapsed condition; and more particularly, to such devices which may include a relatively planar work surface of flexible or rigid material.

BACKGROUND OF THE INVENTION—DESCRIPTION OF THE PRIOR ART

Devices which fold or collapse to facilitate storage and/or transportation and which are, in some manner, rigidized to facilitate use are and have been available. Portable or folding chairs, such as the one shown in U.S. Pat. No. 4,715,650 granted on Dec. 29, 1987 to C. Berman for *Fully Collapsible Portable Chair* are one form of such devices. Other forms of such devices include those shown in U.S. Pat. No. 895,372 granted on Aug. 4, 1908 to J. E. Hostetter et al for *Fishing Rod*; U.S. Pat. No. 1,036,222 granted on Aug. 20, 1912 to J. W. Griffenberg for *Joint For Oars Or The Like*; U.S. Pat. No. 2,474,652 granted on Jun. 28, 1949 to E. V. Block for *Bending Frames Pivotally Connected By Stretch Producing Lines*; and U.S. Pat. No. 2,666,217 granted on Jan. 19, 1954 to R. W. Stuart for *Wheel Stretcher With Patient Retaining Means*. However, the mechanisms shown in these patents utilized to effect or facilitate folding and rigidizing of the device are not conveniently and economically usable where the device incorporates a relatively planar work surface of flexible or rigid material.

U.S. Pat. No. 1,483,979 granted on Feb. 19, 1924 to M. Luery for *Collapsible Cot Bed* describes a cot which folds at a number of joints; but which may very well fold at one or more of the joints when a pressure is applied against the cot surface as might occur if someone were sitting or sleeping on the cot, or if a weight were placed against the cot proximate that joint. Alternative constructions such as those shown in U.S. Pat. No. 3,417,412 granted on Dec. 24, 1968 to J. J. Andrews for *Folding Stretcher* and in U.S. Pat. No. 3,555,578 granted on Jan. 19, 1971 to B. D. Pile for *Lightweight Folding Device* attempt to provide a foldable device with rigidity for the unfolded structure by utilizing complex and relatively expensive hinge structures and cable supports respectively, both of which add to the cost and unacceptability of these constructions. U.S. Pat. No. 2,675,564 granted on Apr. 20, 1954 to R. C. Hughes for *Stretcher*, on the other hand, shows a construction wherein the hinge halves utilized to fold the structure are rigidized by inserting a pin through openings formed through the hinge halves. Such a construction is unacceptable because it requires time, patience and agility to align the holes and insert the pin; while U.S. Pat. No. 3,886,606 granted on Jun. 3, 1975 to J. G. Bradford for *Foldable Casualty Carrier* necessitates an undesirable expenditure of additional time to operate and cost of construction by requiring the use of tubes which are slid over the hinge halves to prevent pivoting thereof on application of force against the structure and which must be slid away from the hinge halves to permit folding of the structure.

Still other such constructions, such as shown in U.S. Pat. No. 2,133,692 granted on Oct. 18, 1938 to W. L. Gittings et al for *Litter* and in U.S. Pat. No. 3,797,051 granted on Mar. 19, 1974 to J. R. Evans for *Foldable Cot*, utilize spring urged slide-type bolts or pins which render the hinge joint rigid when the structure is to be rigidized. However, such constructions not only unacceptably add the cost of movable parts to other costs of the structure but require unacceptable time consuming efforts to operate the mechanism to withdraw pins against spring action simultaneously and at spaced positions in order to fold the structure. Constructions such as shown and described in U.S. Pat. No. 4,670,921 granted on Jun. 9, 1987 to Yoav Avni et al for *Portable Stretcher Which Is Collapsible Into A Compact Package* also require additional expense and time to operate by requiring spring actuated wedges in order to rigidize the hinge-halves.

SUMMARY OF THE INVENTION

It is therefore an object of this invention to provide a new and improved foldable or collapsible device which can be selectively rigidized to provide a work structure.

It is therefore another object of this invention to provide a new and improved device including a collapsible and rigidizable frame upon which a work surface may be supported.

It is another object of this invention to provide a new and improved device including a frame that can carry a work surface of relatively flexible or rigid material which in one condition of the frame can be rendered relatively rigid and in another condition of the frame collapsed into a relatively compact configuration.

It is still another object of this invention to provide a new and improved device having a relatively planar work surface formed from flexible material and supported so as to be either rigidized or collapsible.

It is yet still another object of this invention to provide a new and improved device having a relatively flexible or rigid work surface positionable into a relatively rigid and planar configuration in a first configuration thereof and into a folded and relatively compact configuration is a second configuration thereof.

It is yet still another object of this invention to provide a new and improved collapsible and rigidizable frame upon which a surface or either rigid sections or flexible material may be supported to provide a work surface.

It is yet still another object of this invention to provide a new and improved screen device.

It is yet a further object of this invention to provide a new and improved collapsible frame which may be used for a stretcher or litter.

It is yet a further object of this invention to provide a new and improved screen device which in one configuration is collapsible and foldable into a relatively compact package and in another configuration presents a relatively rigidized work surface of otherwise flexible or rigid material.

It is yet still a further object of this invention to provide a new and improved collapsible and rigidizable shelter.

It is yet still a further object of this invention to provide a new and improved collapsible and rigidizable frames upon each of which a surface of either rigid sections or flexible material may be supported so that when such frame is rigidized the surface carried thereby forms a relatively rigid surface and wherein the rigidized frames are connected together in predetermined configurations to provide shelter-like structures.

It is yet still a further object of this invention to provide new and improved devices which in a first condition are foldable or collapsible into a relatively compact package and in a, second condition are rigidized to form a structure for performing work.

It is yet still a further object of this invention to provide a new and improved device which in a first condition is foldable or collapsible into a relatively compact package and in a second condition is rigidized to form a climbing structure.

It is yet still a further object of this invention to provide a new and improved device which in a first condition is foldable or collapsible into a relatively compact package and in a second condition is rigidized to form a space spanning structure.

Other objects, features and advantages of the invention in its details of construction and arrangement of parts will be seen from the above and from the following description of the preferred embodiments when considered with the drawing and from the appended claims.

DESCRIPTION OF THE PREFERRED EMBODIMENTS

For convenience, this invention will be described as applied to various work structures firstly in the form of stretchers and screens each incorporating frames formed of tubular elements, hinged together at selected locations and each supporting a work surface of relatively flexible canvas material or rigid material such as fiber board or plastic sections. When forming a stretcher the work surface, when rigidized, is to be generally disposed in a horizontal plane to support a person; while when forming a screen the work surface when rigidized is to be generally disposed in a vertical plane to support a display, target or the like. It should be understood, nevertheless, that without departing from the invention that for such work structures: the material utilized to construct the frame may be of any convenient type; that the material for the work surface may also be of any rigid material or fabric appropriate for the application; that the device can be utilized in any suitable disposition and that the work surface may merely function to screen out that which is disposed behind it.

Also, for convenience, those embodiments of the invention wherein it is described as applied to space spanning structures, such as ladders or bridges, are described as constructed in ladder-like configuration of aluminum sections each formed of a center support and a pair of plates disposed to each side of the center support all hinged together and all sections hinged together. Here again, it should be understood, nevertheless, that without departing from the invention that: the material may be aluminum, steel or any other suitable and convenient material based upon the intended use; that any selected number of sections may be utilized; and that center section may be ladder-like or plank-like depending upon the intended uses.

Figure 1:
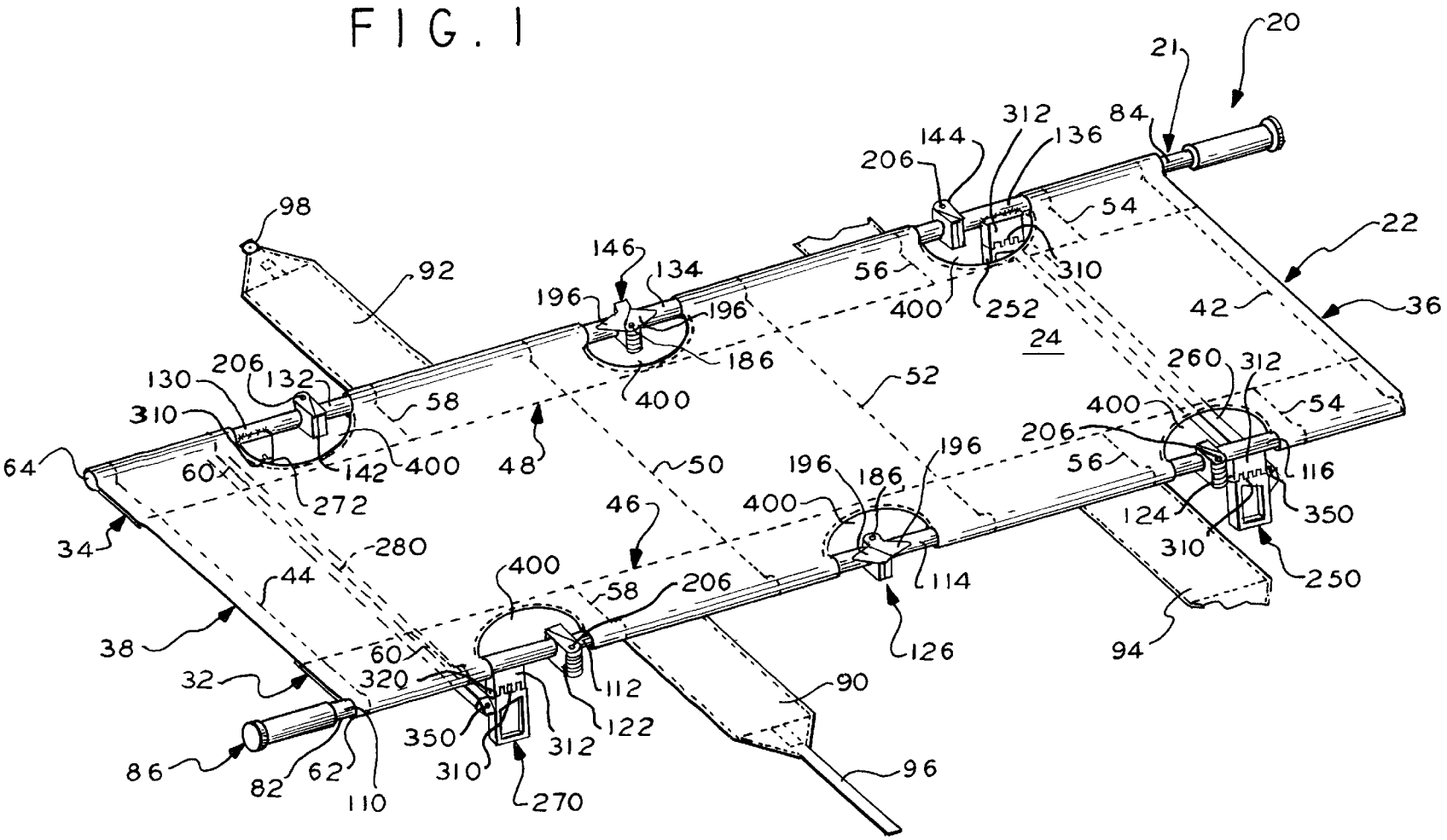
FIG. 1 is a perspective view of a collapsible and rigidizable device, incorporating the instant invention in the form of a stretcher or litter with parts cut away to better show details thereof.
Figure 2:
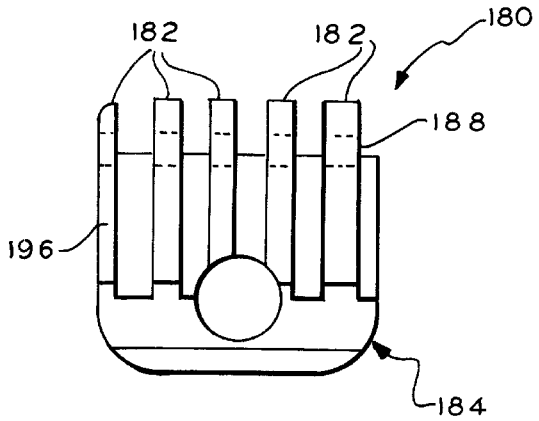
FIG. 2 is an elevation view of a hinge-halve for a first hinge of the device of FIG. 1.

With reference to FIG. 1, there is generally shown at 20 a device in the form of a stretcher or litter incorporating a work surface 22 and a support frame assembly 24.

Work surface 22 is formed of, for example, canvas or other suitable relatively flexible material or work surface 22 may be formed of a relatively rigid material. Whether a relatively flexible or relatively rigid material is used work surface 22 includes a major surface 24 and a pair of folds 32 and 34 that extend the length of work surface 22. It will be understood throughout that where a rigid material is used for work surface 22, fold lines will be formed therein or they will be separate pieces hinged together as will be described in greater detail hereinafter. Folds 32, 34 extend beneath major surface 24 and are secured in place proximate ends 36, 38 of work surface 22 by suitable means such as stitching with appropriate thread at 42, 44. Additional securing of folds 32, 34 is provided to extend the length of work surface 22 by suitable means such as stitching with thread at 46, 48. Further side to side stitching by thread at 50, 52 and at 54, 56 58 and 60 and other places as deemed necessary may be provided. When folds 32, 34 are folded beneath major surface 24 and prior to their being secured in place channels 62, 64 are formed to extend the length of work surface 22 and of a size and configuration to accommodate longitudinally extending members 82, 84 of a support frame assembly 86 of device 20.

A plurality of wraps 90, 92, 94 are also secured to and extend from work surface 22 and provided with straps 96 and buckles 98 (only one shown) to facilitate securing of device 20 into a compact folded condition as will be hereinafter described.

Longitudinally extending member 82 is pole like in configuration and includes a number of sections 110, 112, 114 and 116; with sections 110, 112 and 116, 114 connected by hinge assemblies 122, 124 respectively and with sections 112, 114 connected by hinge assembly 126. Longitudinally extending member 84 is constructed substantially identical to member 82 and includes sections 130 and 132, 134 and 136; with sections 130 and 132 and 136 and 134 respectively connected by hinge assemblies 142, 144 and with sections 132 and 134 connected by hinge assembly 146.

Figure 5:
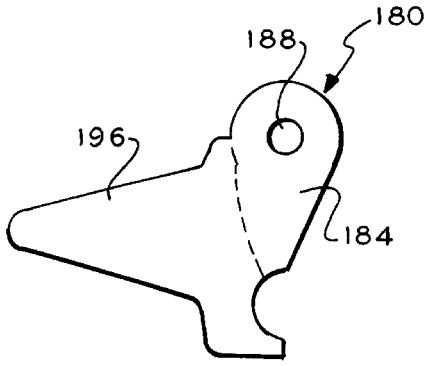
FIG. 5 is a side view of the hinge-halve of FIGS. 2–4.
Figure 3:
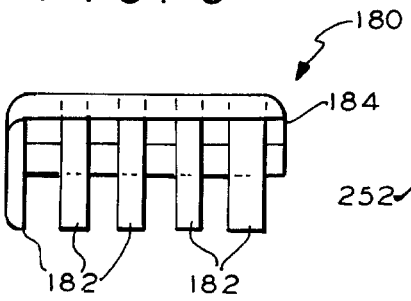
FIG. 3 is a top view of the hinge-halve of FIG. 2.
Figure 4:
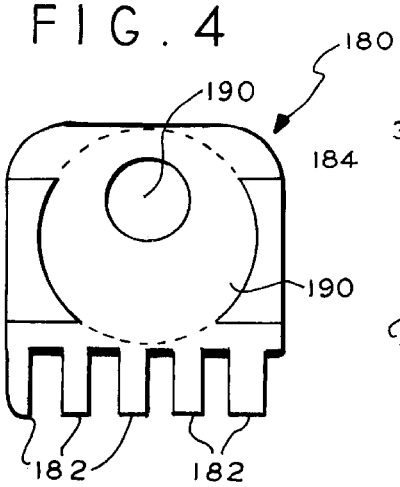
FIG. 4 is an end view of the hinge-halve of FIGS. 2 and 3.

Hinge assemblies 122, 124, 142 and 144 are identical in construction as are hinge assemblies 126, 146 and so only one each of such hinge assemblies will be described in detail. Hinge assemblies 126, 146 each include a pair of substantially identical cooperating hinge-halves 180 (FIGS. 2–5) each of which includes a plurality of fingers 182 extending out from a body 184 and adapted to be alternately disposed between each other. A hinge pin 186 (FIG. 1) when inserted through aligned openings 188 (FIG. 5) formed through hinge bodies 184 interconnects the hinge-halves 180. An opening 190 (FIG. 4) is formed in each hinge-halve 180 to receive the respective end of its section 112, 114; while an opening 192 is provided to receive a securing member such as a screw (not shown) to hold hinge-halves 180 in place on their respective frame sections. A wing 196 (FIGS. 1 and 5) extends out from each hinge-halve 180 for coaction with sections 112, 114 as will be hereinafter described.

Figure 6:
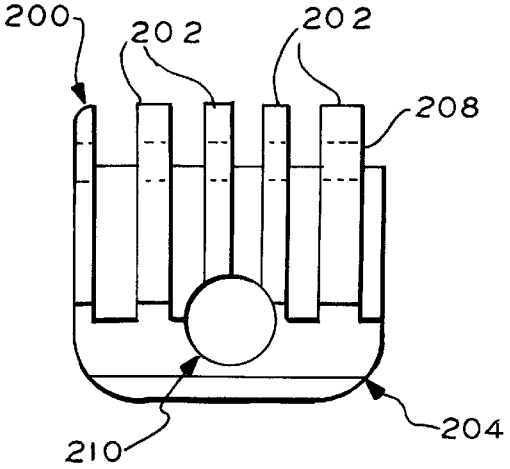
FIG. 6 is an elevation view of a hinge-halve for a second hinge of the device of FIG. 1.
Figure 8:
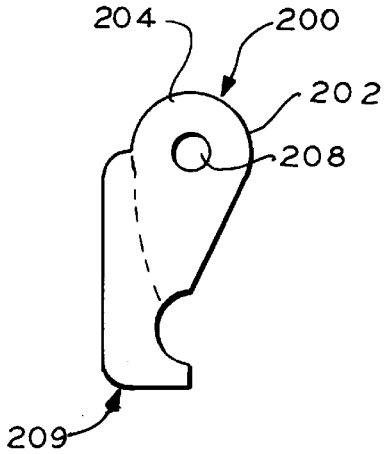
FIG. 8 is a side view of the hinge-halve of FIGS. 6 and 7.
Figure 7:
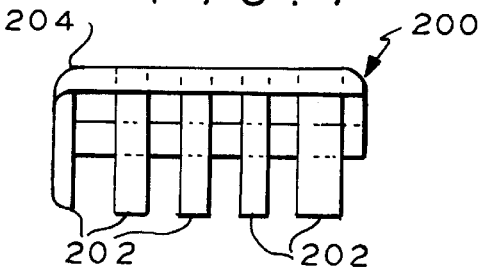
FIG. 7 is a top view of the hinge-halve of FIG. 6.

Hinge assemblies 122, 124, 142 and 144 each include a pair of substantially identical cooperating hinge-halves 200 (FIGS. 6–10) each of which includes a plurality of fingers 202 extending out from a body 204 and adapted to be alternately disposed between each other. A hinge pin 206 (FIG. 1) when inserted through aligned openings 208 (FIG. 8) formed through hinge bodies 204 interconnects the hinge-halves 200. An opening 210 (FIG. 6) is provided to receive a securing member such as a screw (not shown) to hold hinge-halves 200 in place on their respective frame sections. A wing portion 210 extends out from each hinge-halve 200.

If desired hinge assemblies such as 122, 124 may be substituted for hinge assemblies 126, 146, or hinge assemblies such as 126, 146 may be substituted for hinge assemblies 122, 124, 142, 144.

A first pair of support/handle members 250, 252 (FIG. 1) are connected respectively to frame sections 116, 136 and spanned by a cross-bar arrangement 260; while a second pair of support/handle members 270, 272 are connected respectively to frame sections 110, 130 and spanned by a cross-bar arrangement 280.

Figure 11:
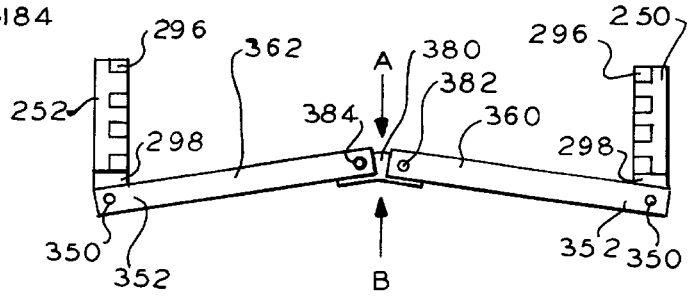
FIG. 11 is a plan view of a stretcher for the device of FIG. 1.
Figure 12:
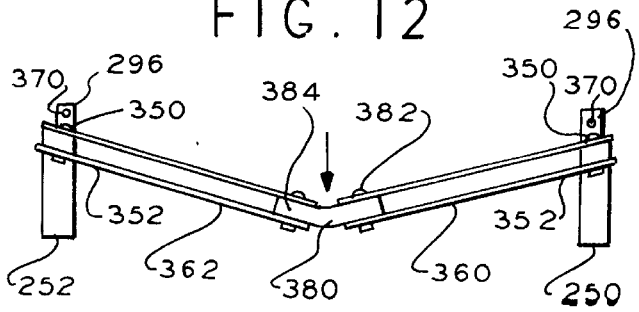
FIG. 12 is an elevation view of the stretcher of FIG. 11.
Figure 9:
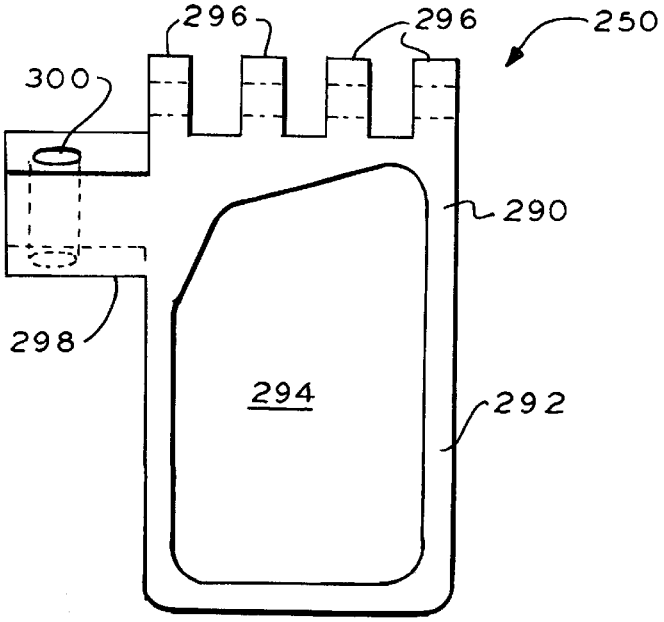
FIG. 9 is an elevation view of a handle/support leg of the device of FIG. 1.
Figure 10:
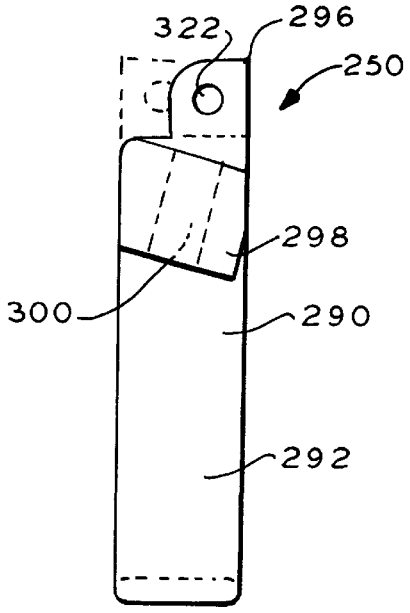
FIG. 10 is an end view of the handle/support leg of FIG. 9.

Support/handle members 250, 252, 270 and 272 are identical in construction and each includes a body 290 (FIGS. 9 and 10) having a leg/handle portion 292 with an opening 294 (FIG. 9) therethrough and a plurality of fingers 296 (FIGS. 9 and 10). A leg 298 extends out from body 290 and includes an opening 300. Fingers 296 are formed and disposed for mating engagement with fingers 310 of a mounting member 312 (FIG. 1); their being a mounting member 312 secured to frame sections 110, 116, 130, 136 by suitable means such as welding or the like. A hinge pin 320 extends through aligned openings (not shown) formed through fingers 310 and interspersed and aligned openings 322 (FIG. 10) formed through support/handle body 290. A pivot pin 350 (FIGS. 1 and 11) pivotally connects each support/handle to an end 352 (FIGS. 11 and 12) respectively of cross-bar arrangements 260, 280 which are also identical in construction.

Each cross-bar arrangement 260, 280 includes a pair of "U" shaped channel sections 360, 362 (FIGS. 11 and 12), each pivotally connected at first ends to a respective support/handle 250, 252, 260, 262 as by pivot pins 370 which pass through openings 300 of legs 298, and which are pivotally connected together at their other or second ends by a connector block 380 secured as by pivot pins 382, 384 to channel sections 360, 362 respectively. Cross-bar arrangements 260, 280 function as stretching means or members and in identical manners. That is, when force is applied thereto, in the direction of arrow A and proximate their respective connector blocks 380 bar sections or stretching members 360, 362 are unflexed and longitudinally moved into in a relatively straight line arrangement (FIG. 1). This action, in turn, applies a rigidizing force against support/handles 250, 252, and 260, 262 respectively, preventing support/handles 250, 252 and 260, 262 from pivoting about pins 320 as will be hereinafter explained. Applying a force in the direction of arrow B to connectors 380 (to move them to their FIG. 11 and 12 position) relieves the rigidizing force from support/handles 250, etc for purposes to be hereinafter explained.

Work surface 22 is formed with openings 400 to facilitate access to the various hinge assemblies while openings 62, 64 are also of a size and configuration to permit rotation of frame members 82, 84 about a longitudinal axis extending therethrough.

When frame members 82, 84 are disposed as shown in FIG. 1 cross-bar arrangements 260, 280 are straight and rigid and hinge assemblies 122, 124, 126, 142, 144 and 146 are disposed with their hinge pins 186, 206 in a vertical orientation. Frame sections 110, 112, 114, 116, 130, 132, 134 and 136 cannot be folded because the respective hinge assemblies cannot pivot in a direction to permit folding of the various frame sections of the device. Thus, forces applied against the upper surface of work surface 22, especially proximate the hinge joints, will not result in folding of frame assembly 24 about the hinge joints. Wings 196,of hinge assemblies 126 coact with adjacent frame sections 114, 116 and 134, 136 to further rigidize same in this configuration. Applying appropriate forces in the direction of arrow A to cross-bar arrangements 260, 280 (to move them to their FIG. 11 and 12 configurations) relieves forces on support handles 250, 252, 260, 262 and permits rotation thereof with frame members 82, 84 about the axis extending through frame members 82, 84.

A rotation of ninety degrees of frame members 82, 84 will also rotate the various hinge assemblies 122, 124, 126, 142, 144, 146 and orient their respective hinge pins 186, 206 into horizontally extending planes substantially parallel to work surface 22 and into axes about which sections of device 20 are to be folded. In this configuration, hinge assemblies 126, 146 can be pivoted so that frame sections 110, 112 and 130, 132 fold towards frame sections 114, 116 and 134, 136 respectively. Also, frame sections 110, 130 can fold against frame sections 112, 132 while frame sections 116, 136 can fold against frame sections 114, 134. With cross-bar arrangements 260, 280 relaxed the support/handles can also pivot beneath work surface 22 and the entire device secured by flaps 90, 92, 94; the material and construction of connector blocks 380 permitting such pivoting movement.

To unfold device 20 the hinge assemblies 122, 124, 126, 142, 144 and 146 are oppositely operated to straighten out the frame sections into a substantially planar configuration. Frame members 82, 84 are rotated to place pins 186, 206 of hinge assemblies 122–126 and 142–146 in vertical orientation and cross-bar arrangements 260, 280 are straightened into rigid configurations.

Figure 13:
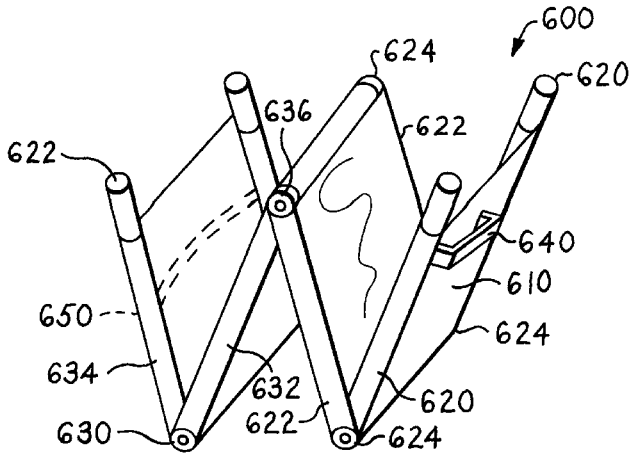
FIG. 13 is a schematic perspective of the devices of the litter of FIG. 1 in a partially collapsed or folded condition.

FIG. 13 shows an alternative embodiment of a collapsible and rigidizable device 600 in both a rigidized configuration 602 and folded configuration 604. Device 600 is substantially identical in construction to device 20 (of FIGS. 1–12) and includes a work surface (FIG. 13) 610 of flexible material such as canvas. Frame members 620, 622 are formed in sections, just like frame members 82, 84 (FIGS. 1–12), with hinge assemblies 624, similar to hinge assemblies 122, 126 etc, connecting frame members 620, 622 together and with a hinge assembly 630 connecting frame members 632, 634 together in a manner identical to the manner of interconnection for frame sections of device 20. Cross-bar arrangements 640, 650 identical to cross-bar arrangements 260, 280 span frame members 620, 622 and are interconnected thereto and function therewith as for cross-bar arrangements 260, 280 of device 20. Thus when suitable forces are applied to relax cross-bar arrangements 640, 650 frame members 620 and 622 may be folded towards each other, (FIG. 13) about hinge 624, frame members 632 and 634 may be folded towards each other about hinge assembly 630 and frame members 622 and 632 folded towards each other about hinge assembly 636.

Work surface 610 is, in this configuration, somewhat larger than work surface 22 of device 20, and in its rigidized configuration to be set up in a vertical or substantially vertical orientation. As such device 600 functions as a screen to hide or obscure anything to its rear. Alternatively materials such as photos, signs or the like may be carried by a face surface of device 600 for presenting a picture, message or the like to the observer.

Figure 15:
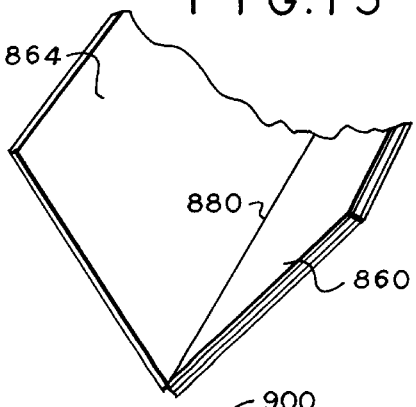
FIG. 15 is a perspective showing of a pair of hingedly connected surface panels of the device of FIG. 14 showing a first hinging arrangement.

FIG. 15 shows an alternative embodiment of a collapsible and rigidizable device 800 in its rigidized condition. Device 800 is substantially identical in construction to devices 20 (FIG. 1) and 600 (FIG. 13) and includes frame members 802, 804 connected to each other by cross-bar arrangements 806, 808. Each frame member includes a plurality of sections 810, 812, 814 and 816 connected together by hinge assemblies 820, 822, 824 respectively. Device 800 includes a work surface 850, and except for details of work surface 850 to be hereinafter described, collapses or folds and is rigidized by application of suitable forces to cross-bar arrangements 806, 808, rotation of frame members 802, 804 and pivoting of frame sections 810, 812, 814, 816 about their respective hinge assemblies 820, 822, 824 all in the same manner as described for comparable members of devices 20 and 600.

Figure 14:
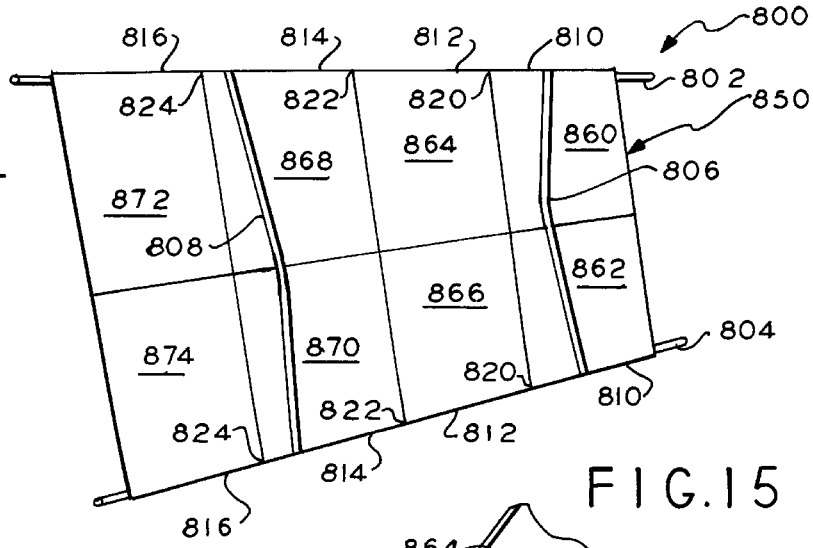
FIG. 14 is an elevational view of a collapsible and rigidizable device, incorporating the instant invention, forming a wall-like structure and incorporating a plurality of relatively rigid panels to form the wall surface.

Work surface 850, however, is formed of material relatively more rigid than the flexible canvas of devices 20 and 600. Work surface 850 includes a plurality of individual panels 860, 862, 864, 866, 868, 870, 872 and 874 of somewhat more rigid material like a plastic. Panels 860–874 are, in turn, connected together by suitable hinge means 880 (FIGS. 14 and 15). Any conventionally available hinge may be utilized but in this instance hinge 880 is also formed of plastic and in a conventional way when panels 860, 864 are formed.

Figure 16:
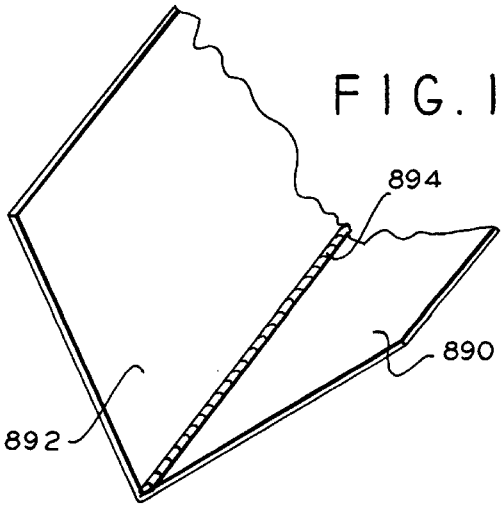
FIG. 16 is a perspective showing of an alternative hinging arrangement for surface panels of the type utilized for the device of FIG. 14.

Alternatively, panels 860–874 may be replaced by panels such as panels 890, 892 (FIG. 16) which are formed of cardboard or similar somewhat rigid but lightweight material. A piano type hinge 894 is suitably secured to adjacent edges of panels 890, 892 and hingedly connects them to each other.

The hinged connections between the various panels 860–874 (or 890, 892 etc) are connected to their respective adjacent panel members and disposed to hinge in suitable direction so that work surface 850 folds into a compact package along with frame members 802, 804. The hinged connections may also be formed by weakening the material of the work surface along the respective hinge lines such as by perforations, pressure lines, or the like.

Figure 17:
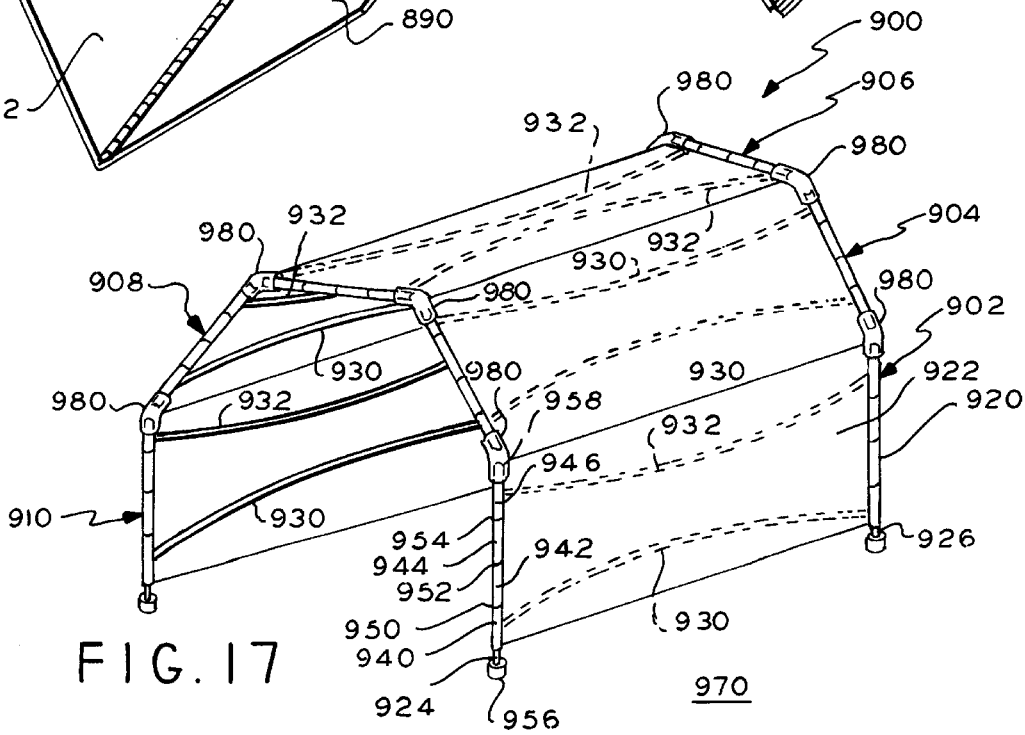
FIG. 17 is a perspective schematic of a plurality of devices of the type shown in FIGS. 1, 14 modified if required and connected together to form a shelter-like structure.

The devices of FIG. 1, result in constructions of predetermined relative width (or height) and length but of relatively narrow thickness. However, constructions of relatively larger size in all three directions (or dimensions) are possible as a further embodiment of this invention as shown in FIG. 17 wherein there is shown at 900 a three dimensional construction in the form of a shelter.

Shelter 900 is constructed from a number of devices 902, 904, 906, 908 and 910. Each device 902–910 is substantially identical and of a construction corresponding to that of the device of the embodiments of FIGS. 1–12, FIG. 13 or FIGS. 14–16, or combinations thereof. By a corresponding construction is meant that each device 902–910 includes a support frame assembly 920 and a work surface 922. Each support frame assembly 920 is constructed substantially similar to the support frame assemblies of the previously described embodiments and includes a pair of spaced longitudinally extending members 924, 926 interconnected in spaced relationship by cross-bar assemblies 930, 932. Each longitudinally extending member 924, 926 is, in turn, formed from a number of support sections 940, 942, 944, 946 connected together by hinge assemblies 950, 952, 954 and include at their respective ends hand grips 956, 958. Longitudinally extending members 924, 926 are carried by, and in turn carry, work surface 922 so that they can be rotated about axes extending through their respective lengths, as described for the previously described embodiments. Thus, suitable application of forces to cross-bar assemblies 930, 932 to rigidize and straighten same while members 924, 926 extend straight out will rigidize each respective work surface 922; while suitable application of forces to cross-bar assemblies 930, 932 to relax cross-bar assemblies 930, 932 will permit rotation of members 924, 926 and folding of the respective support sections thereof, of the respective work surfaces 922 thereof and of each device 902–910 into a compact package all as described above for the previous embodiments.

When forming structure 900 each device 902–910 to be used is unfolded, its longitudinally extending members 924, 926 are extended their full lengths, their work surfaces 922 are spread out, and their cross-bar assemblies 930, 932 are operated to rigidize each respective device. Devices 902 and 910 are then positioned with their respective longitudinally extending members 924, 926 disposed vertically up and either held or otherwise secured in that position. Hand grips 956, 958 may, if desired, be planted in the supporting ground or surface 970. Device 904 is then positioned with its respective longitudinally extending members 924, 926 aligned with those of device 902 but at an angle with respect thereto. A sleeve 980 is positioned over adjacent hand grips 956, 958 at each end of devices 902, 904. Device 908 is similarly mounted with respect to device 910 with sleeves 980 connecting the respective adjacent hand grips 956, 958 at each end thereof. Device 906 is then positioned between devices 902, 908 by similar disposition of sleeves 980 over adjacent hand grips 956, 958.

Either sleeves 980 may be formed with bends to accommodate the particular angles at which the respective devices meet or the hand grip portions of the devices bent at predetermined and selected angles and suitably configured sleeves applied thereto or combinations thereof utilized to interconnect the respective devices 902–910 to form construction 900.

The material utilized for surfaces 922 may be flexible such as a canvas or a flexible plastic or it may be rigid such as board, cardboard, rigid plastic or the like all as described for the previous embodiments.

While construction 900 has been shown formed from five devices 902–910 either more or less devices may be utilized depending upon the size and configuration of the final construction. In addition, while construction 900 has been formed with the respective longitudinally extending members forming front and rear edges 990, 992, devices 902–910 may also have been disposed so that their respective longitudinally extending members would extend front to back at ninety degrees to those of the construction of FIG. 17.

Another foldable or collapsible and rigidizable structure, in the form of a space spanning ladder like structure is shown in the device of FIGS. 18–27 wherein there is shown at 1000 a rigidized ladder-like device positioned upon a surface like ground 1002 and up against a wall 1004. Device 1000 includes a plurality of sections 1010 (FIGS. 18, 19 and 20) which are disposed one adjacent the other and hingedly connected together as will be hereinafter described, and which for purposes of facilitating this description are identified as 1010-1, 1010-2, 1010-3, . . . 1010-n to signify that there can be any desired number of sections depending upon the intended end use or uses for device 1000.

Sections 1010 are substantially identical and each include a center support 1020 (i.e. 1020-1, 1020-2, 1020-3, etc) (FIGS. 20 and 21), and a plurality of side plates 1030 (i.e. 1030-1, 1030-2, 1030-3, etc) 1040 (i.e. 1040-1, 1040-2, 1040-3, etc), 1050 (i.e. 1050-1, 1050-2, 1050-3, etc), and 1060 (1060-1, 1060-2, 1060-3, etc). Plates 1030, 1040, 1050 and 1060 and center supports 1020 are respectively all identical in construction but adjacent center supports 1020 and plates 1030, 1040, 1050 and 1060 are disposed and hingedly connected in different dispositions for purposes and as will be hereinafter explained.

Figure 21:
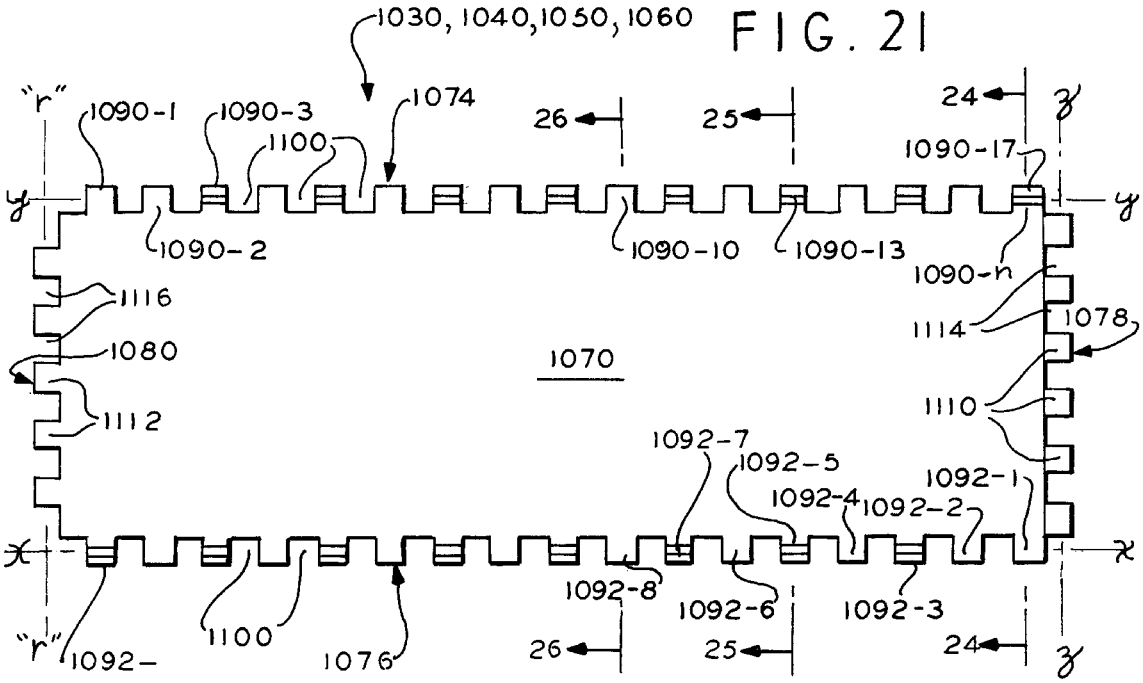
FIG. 21 is a plan view of one of the plates utilized to form the device of FIGS. 19 and 20.
Figure 22:
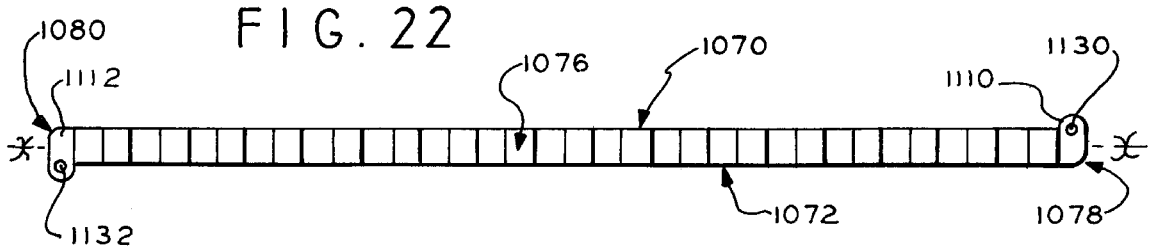
FIG. 22 is a side elevation view of the plate of FIG. 21.

Each plate 1030, 1040, 1050, 1060 (FIGS. 20 and 21–25) is fabricated, as by molding or other suitable and appropriate process, from heavy duty aluminum, steel or similar suitable material and includes a first surface 1070 (FIGS. 21–25), a second surface 1072 (FIGS. 21–25), a first side (FIG. 21) a second side 1076 (FIGS. 21 and 22), a first end 1078 and a second end 1080. A plurality of hinge teeth 1090 are formed along and extend from first side 1074 (FIG. 21); while a similar plurality of hinge teeth 1092 are formed along and extend from second side 1076 (FIGS. 21 and 22). The number of hinge teeth 1090, 1092 will depend upon the size of plates 1030, 1040, 1050 1060 but are preferably even in number. Hinge teeth 1090, 1092 are separated from each other by spaces 1100 of a size and configuration to receive hinge teeth (1090 or 1092) when plates 1030, 1040, 1050, 1060 are place adjacent one another with their respective hinge teeth mating and interconnected to form a hinge as will be hereinafter further explained.

Figure 24:
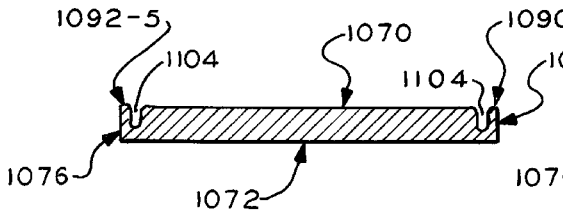
FIG. 24 is an end elevation sectional view taken on line 25—25 of FIG. 22.
Figure 23:
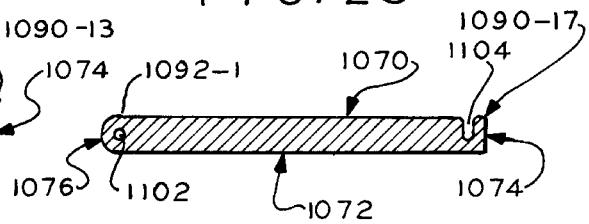
FIG. 23 is an end elevation sectional view taken on line 24—24 of FIG. 22.
Figure 25:
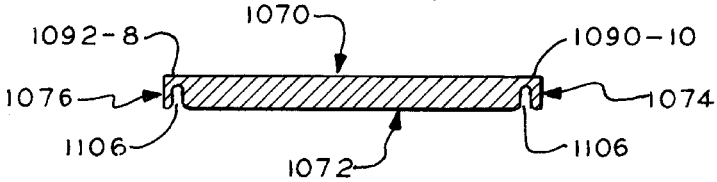
FIG. 25 is an end elevation sectional view taken on line 26—26 of FIG. 22.

A first hinge tooth 1090-1 (FIG. 21) and 1092-1 (FIGS. 21 and 23) is formed on each side to include a hinge pin hole 1102 (FIG. 23) extending therethrough. Those hinge teeth disposed in the rest of the odd numbered positions (i.e. hinge teeth 1090-3, 1090-5, 1092-3, 1092-5, etc) are each formed with and include a hinge pin cut 1104 open towards first surface 1070 as shown for hinge teeth 1090-17. (FIG. 24) and 1090-13 and 1092-5 (FIG. 24). Those hinge teeth disposed in even numbered positions (i.e. hinge teeth 1090-2, 1090-4, 1092-2, 1092-4, etc) are each formed with and include a hinge pin cut 1106 open towards second surface 1072 as shown for hinge teeth 1090-10 and 1092-8 (FIG. 25). Hinge pin cuts 1104 (i.e. those open towards surface 1070) and 1106 (i.e. those open towards surface 1072) may be respectively reversed and formed in hinge teeth disposed in even and odd positions respectively if desired as long as the upwardly opening hinge pin cuts and downwardly opening hinge pin cuts alternate along each side 1074, 1076 of plate 1030, 1040, 1050 and 1060; and as long as similarly facing cuts are in similar positions along each side as shown and described.

The bottom surface of hinge pin cuts 1104, 1106 are arranged to be coplanar with hinge pin holes 1102 and so as to lie in a plane which bisects the space between surfaces 1070 and 1072 to thus lie along hinge axes "x-x" and "y-y" (FIG. 21) respectively.

A plurality of hinge teeth 1110 (FIGS. 21 and 22) are formed along and extend from first end 1078; while a similar plurality of hinge teeth 1112 are formed along and extend from second end 1080. Hinge teeth 1110 are spaced from each other along end 1078 by spaces 1114 (FIG. 21); while hinge teeth 1112 are spaced from each other along end 1080 by spaces 1116. Spaces 1114 and 1116 alternate with hinge teeth 1110 and 1112 respectively and are sized to receive hinge teeth 1110 and 1112 respectively to form hinges as will be described in more detail later.

A hinge pin hole 1130 (FIG. 22) is formed through hinge teeth 1110 to form a hinge axis "z-z" (FIG. 21) lying in the plane of first surface 1070; while a hinge pin hole 1132 (FIG. 22) is formed through hinge teeth 1112 to form a hinge axis "r-r" (FIG. 21) lying in the plane of second surface 1072.

Figure 26:
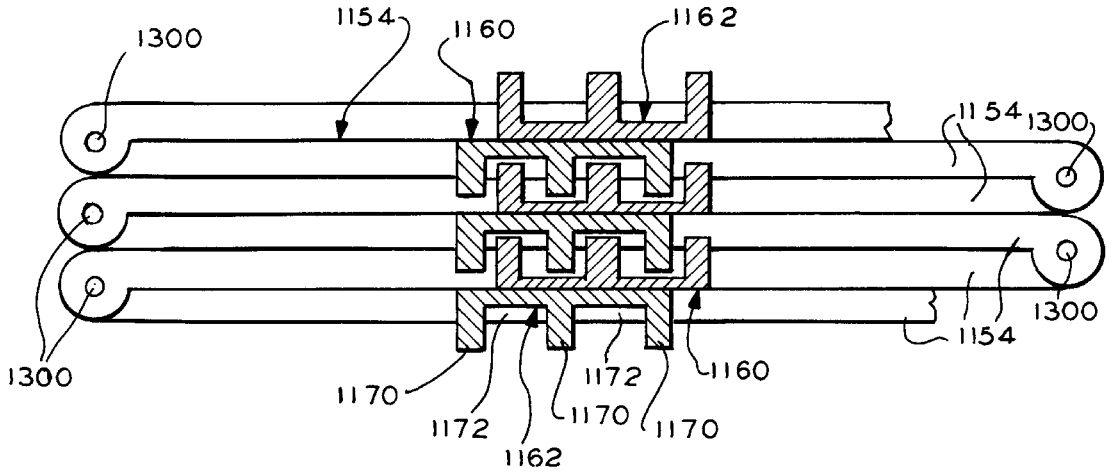
FIG. 26 is an elevation sectional view taken as though on line 27—27 of FIG. 22 but showing a few sections of the device folded or collapsed.
Figure 19:
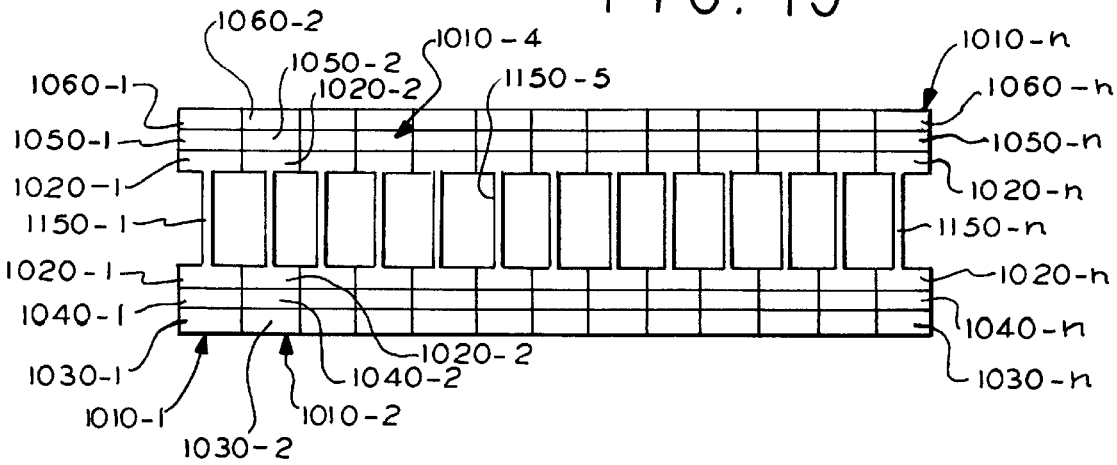
FIG. 19 is a schematic plan view of the ladder-like work structure of FIG. 18 in an intermediate condition between a rigidized condition and a folded or collapsed condition.
Figure 20:
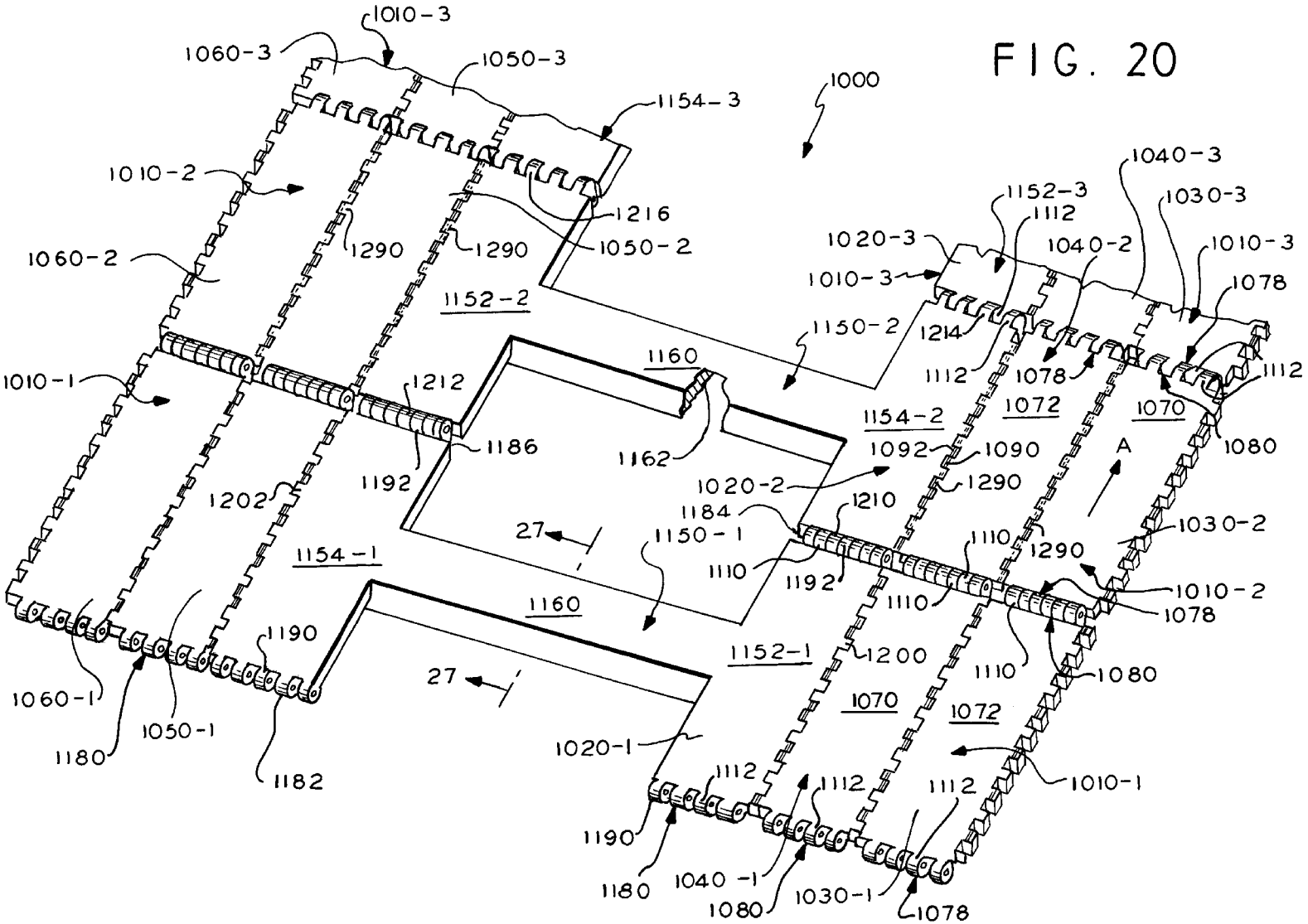
FIG. 20 is a perspective showing of a portion of the ladder-like work structure in its FIG. 19 intermediate condition enlarged to better show details thereof.

Each center support 1020 is substantially "H" shaped in configuration and includes cross-bar 1150 (FIGS. 18–20) spanning a pair of spaced side plates 1152, 1154 (FIG. 20). Center supports 1020 are each formed, as by molding, of the same material or materials as side plate 1030–1060 and each includes a first surface 1160 (FIGS. 20 and 26) and a second surface 1162; and each have their respective cross-bar 1150 formed almost twice as thick as their side plates 1152, 1154 (which are the same thickness as plates 1030–1060). Surfaces 1160 of center support 1020 each include a number of ribs 1170 (FIG. 26) spaced one from the other by channels 1172 such that in the folded condition of device 1000 ribs 1170 of one center support 1020 nest into channels 1172 of a next adjacent center support 1020. In fact, in the folded condition of device 1000 successive cross-bars 1150 are disposed first surface 1160 adjacent first surface 1160, then second surface 1162 adjacent second surface 1162 with their respective ribs 1170 nested in grooves 1172, and then with adjacent first surfaces 1160 adjacent each other as shown in FIG. 26. The nesting of ribs 1170 and grooves 1172 is facilitated by disposing each cross-bar 1150 so as to be disposed in an offset position relative to first edges 1180, 1182 and second edges 1184, 1186 of side plates 1152, 1154 respectively and so as to be closer to first edges 1180, 1182 thereof.

Edges 1180, 1182 each include a number of spaced hinge teeth 1190 similar to hinge teeth 1110 of plates 1020 and with hinge pin holes (not shown) extending therethrough so that their centers lie in the plane of first surface 1160; while edges 1184, 1186 each include a number of spaced hinge teeth 1192, similar to hinge teeth 1112 of plates 1020 and with hinge pin holes (not shown) extending therethrough so that their centers lie in the plane of second surface 1162 of side plates 1152, 1154.

Each side plate 1152, 1154 also includes an outer side 1200, 1202 each of which is also formed with spaced hinge teeth but of a configuration and disposition corresponding to hinge teeth 1090, 1092 of plates 1020 and with alternate successive teeth formed with hinge pin cuts facing towards surface 1160 or surface 1162 as for cuts 1104, 1106 so as to cooperate with the corresponding hinge teeth of plates 1020.

Center supports 1150 alternate in construction, with those to be disposed, for example, in odd positions (1, 3, 5, etc) having their respective hinge teeth 1180, 1182 with the center of their hinge pin holes disposed in the plane of first surface 1160 and with their hinge pin teeth 1184, 1186 with the centers of their hinge pin holes disposed in the plane of second surface 1162 of side plates 1152, 1154. Alternatively, center supports 1150 disposed, for example, in even positions (2, 4, 6, 8, etc) have their respective hinge teeth 1210, 1212 (FIG. 20) with the centers of their hinge pin holes disposed in the plane of second surface 1162 of side plates 1152, 1154 and with their hinge pin teeth 1214, 1216 disposed with the centers of their hinge pin holes disposed in the plane of first surface 1160.

Each section 1010 of device 1000 is thus formed as shown in the figures and described above by taking a center support 1150 and assembling thereto side plates 1020. In the construction shown in FIG. 20, for example, for section 1020-2 side plate 1030-2 is disposed with its first surface 1070 up and with its edge 1078 disposed in the direction of arrow A. Adjacent plate 1040-2 is disposed with its second surface 1072 up and with its edge 1080 disposed in the direction of arrow A. Center section 1150 is selected so that its side plate 1154-2 to be disposed adjacent plate 1042-2 will have its hinge teeth 1214 disposed so that their respective holes align with those of hinge teeth 1112 of plate 1040-2 and 1110 of plate 1030-2. When so disposed hinge teeth 1090, 1092 of the respective side plates mesh with each other to align hinge cuts 1104, 1106 respectively. Side plates 1050-2 and 1060-2 are similarly disposed adjacent each other and side plate 1154-2 all with their respective hinge teeth aligned and meshing one with the other. Longitudinal hinge pins 1290 are thereafter threaded through aligned holes 1130, 1132 and hinge pin cuts 1104, 1106 to form hinge axes of rotation "x-x" and "y-y" (FIG. 21). Hinge pins 1290 are formed with a length corresponding to that of the meshed hinge teeth 1090, 1092.

Adjacent section 1020 (1020-1, 1020-2, 1020-3, . . . 1020-n) are then assembled by meshing hinge teeth 1110, 1112 and 1180, 1182, 1184, 1186 so that their respective hinge pin axes "r-r" and "z-z" (FIG. 21) align. Hinge pins 1300 (FIG. 26) are inserted therethrough to form the hinges. Each hinge pin is of a length corresponding to the meshed teeth 1110, 1112, 1184, 1210 etc. Full circle hinge pin holes, such as 1092-1 (FIG. 23), are disposed at respective ends of each set of plates (1030–1060) and the alternate disposition of hinge pin cuts (up and down) 1104, 1106 prevent hinge pins 1290 from lifting out of the hinge pin teeth; while the ends of hinge pins 1290 may be staked or otherwise prevented from sliding out of said hinge pin holes and cuts. Hinge pins 1300 are similarly staked or otherwise secured in position.

Figure 27:
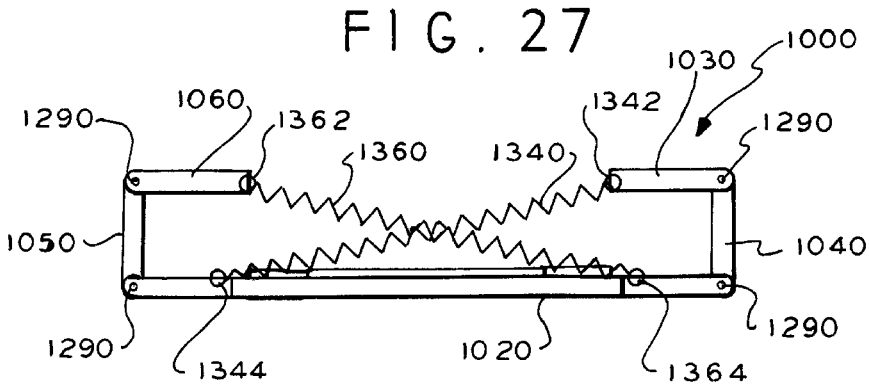
FIG. 27 is an end view of the device of FIG. 18 showing details thereof.

The axis of rotation of hinge pins 1300 are selected to facilitate alternate folding of sections 1010 one upon the other as shown in FIG. 27 (i.e. with hinge axis of rotation alternating in the plane of first surface 1070 and 1072). The axis of rotation of hinge pins 1290 are disposed to bisect the space between first surface 1070 and second surface 1072 to facilitate folding of side plates 1030–1060 as will be hereinafter explained and described.

Figure 18:
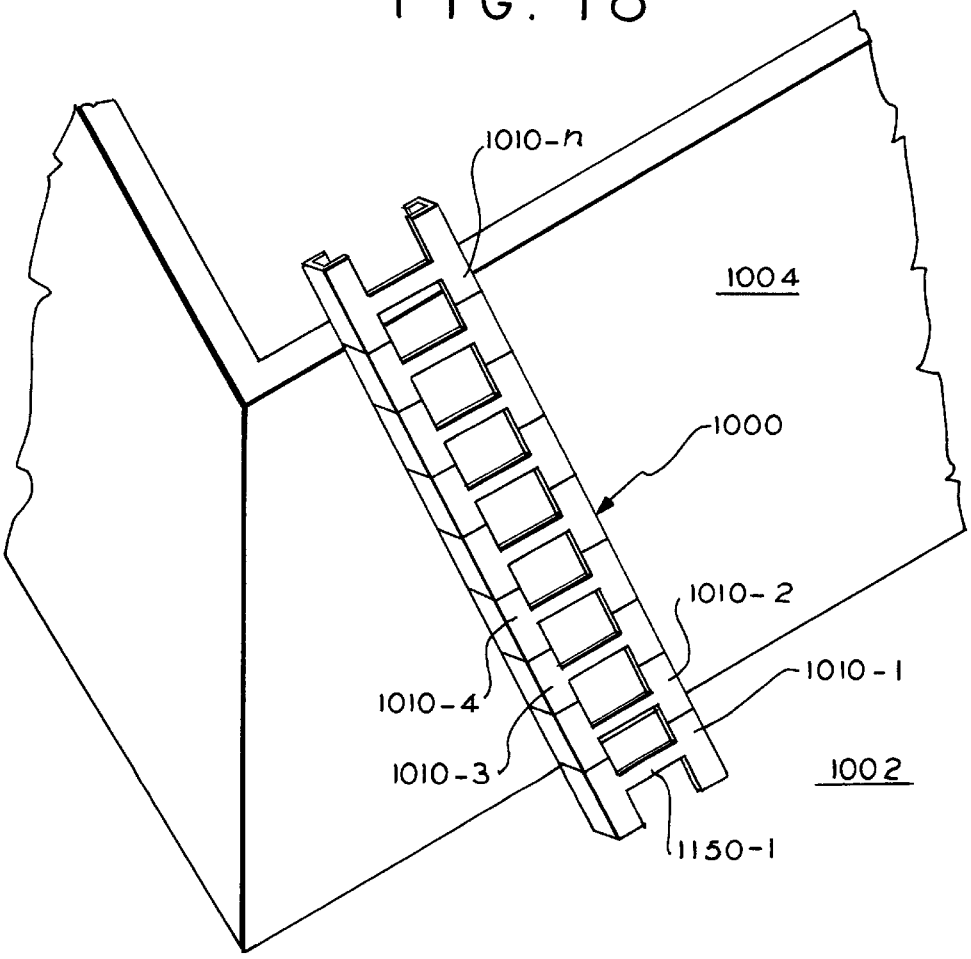
FIG. 18 is a schematic perspective of another embodiment of this invention showing a ladder-like work structure incorporating the instant invention disposed in position to facilitate climbing a wall.

When device 1000 is disposed as shown in FIG. 19 (and in greater detail but not fully in FIG. 20) center supports 1050 and side plates 1030–1060 all lie substantially in the same plane. As such, section 1010-1, 1010-2, etc may be alternately folded at their respective hinge axes and device 1000 placed in a compact, relatively space saving, relatively easy to transport condition as shown for part of device 1000 in FIG. 26. If it is desired to put device 1000 to use, say as a ladder as shown in FIG. 18, then one only needs to unfold sections 1010-1, 1010-2, etc., so that the entire device occupies a horizontal, relatively flat, disposition.

A first spring 1340 (FIG. 27) is disposed with one of its ends 1342 connected to an outer side of a plate 1030 [preferably near a center (end to end) of device 1000] and its other end 1344 connected to the aligned center section 1020. A second spring 1360 is disposed with one of its ends 1362 connected to an outer side of a plate 1060 of the same centrally disposed section 1010 and with its other end 1364 connected to aligned center section 1020. Springs 1340, 1360 are selected to exert sufficient forces on plates 1030, 1060 to urge all the aligned plates 1030, 1060 to rotate about their respective hinge axes 1290 and aligned plates 1040, 1050 to similarly rotate around their respective hinge pin axes 1290 to move plates 1030, 1040, 1050, 1060 from their relatively planar FIGS. 19 and 20 disposition to their box-channel-like FIGS. 18 and 27 disposition. In this disposition device 1000 is fully rigidized and strong enough to function as a space spanning device in the form of the ladder shown.

Figure 28:
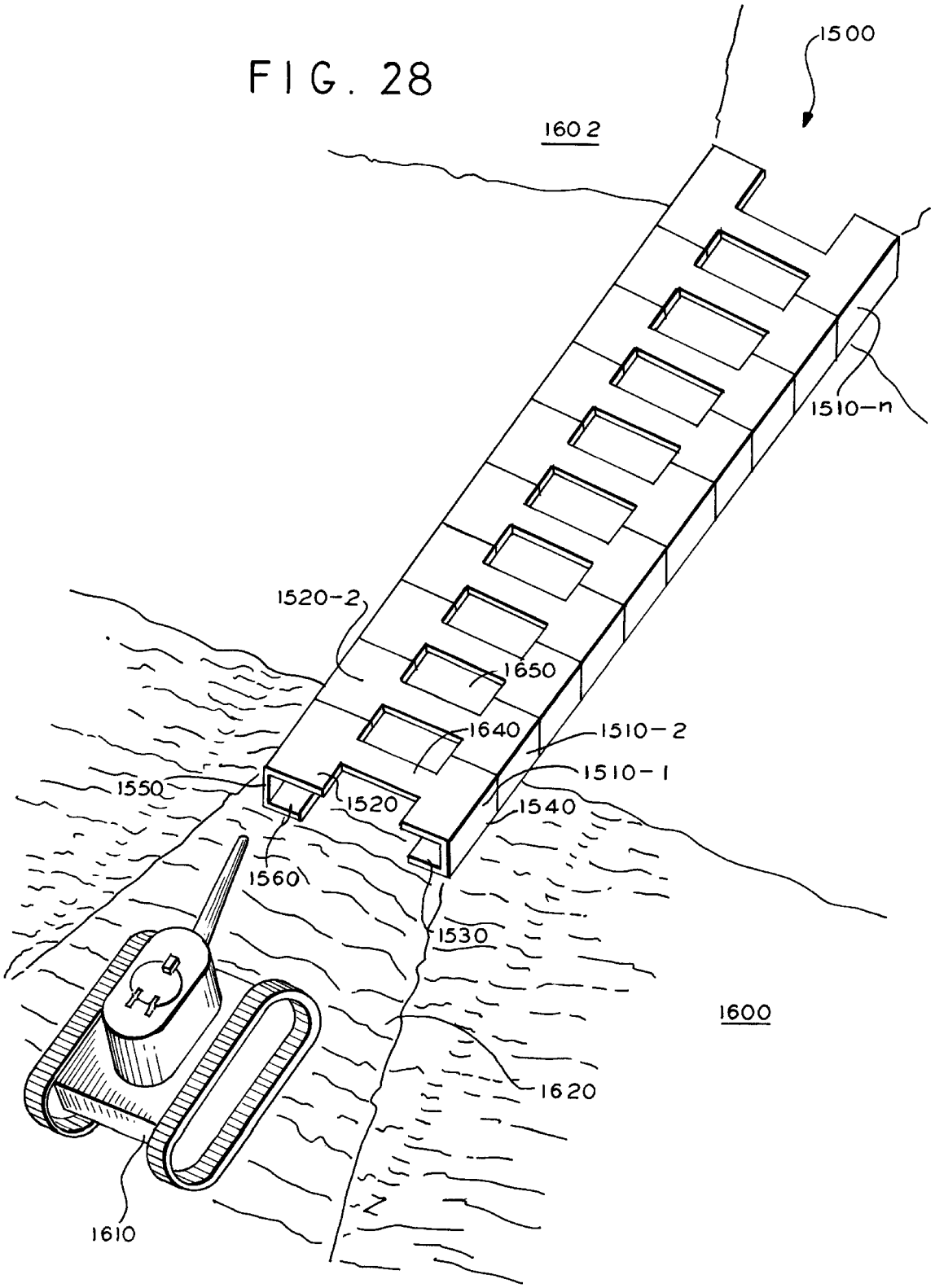
FIG. 28 is a schematic perspective showing of yet another embodiment of this invention showing a bridge-like space spanning structure incorporating the instant invention and disposed in position to facilitate the crossing of a stream by a vehicle.

In FIG. 28 there is schematically shown another embodiment of space spanning structure 1500 incorporating the instant invention. Device 1500, like device 1000 (FIGS. 18–27) is formed with a plurality of hingedly connected sections 1510 (1510-1, 1510-2, 1510-n). Each section 1510 is formed with a center support 1520 and side plates 1530, 1540, 1550, and 1560 all formed, fabricated and hingedly connected together as for plates 1030, 1040, 1050 and 1060 and center sections 1020 of the previously described embodiment.

The center supports 1520 and plates 1530–1560 of device 1500 are, however, formed from relatively heavier stock and relatively stronger materials then those of device 1000. The size, thickness, material and number of sections 1570 being selected depending upon the space to be spanned and the load that is to traverse the span. In the embodiment shown the space to be spanned constitutes, for example, a stream such that respective ends of device 1500 are to be disposed on opposite banks 1600, 1602 thereof. The load to traverse device 1500 is, in this instance, a vehicle in the form of a military tank 1610. If desired a dirt embankment 1620 of slopped configuration can be disposed at each end of device 1500 to facilitate entry thereupon of load 1610 and exit thereof.

Cross-bars 1640 of device 1500 may be formed more like planks rather than the ladder rungs of device 1000 if the strength is required. Spaces, such as spaces 1650 may be provided between cross-bars 1640 if removal of material will facilitate reducing the weight of device 1500 and transport thereof.

One or more sets of springs (not shown) similar in disposition to springs 1340, 1360 (FIG. 27) may be correspondingly secured to the plates and center sections of device 1500 (FIG. 28) to facilitate rigidizing thereof. Folding of device 1500 is accomplished as explained above for device 1000.

From the above description it will thus be seen that there has been provided new and improved collapsible and rigidizable devices which present a substantially planar work surface when in a rigid configuration and which readily collapse and fold for storage and transportation and which can also be utilized to construct shelter-like structures and to span spaces either vertically, horizontally, or otherwise.

It is understood that although I have shown the preferred forms of my inventions that various modifications may be made in the details thereof without departing from the spirit as comprehended by the following claims.

What is claimed is:

1. A space spanning structure of selected longitudinal extent and selected width; comprising:

(a) a plurality of section means arranged serially one adjacent the other;

(b) each of said section means being of said selected width and of a predetermined longitudinal dimension such that a selected number of said section means when disposed serially, one adjacent the other, extend to said predetermined longitudinal extent;

(c) a plurality of first hinge means hingedly connecting adjacent ones of said section means so that said section means may be disposed in either a folded condition disposed one against the other into a relatively compact package substantially one section means in longitudinal extent and width, or into an unfolded condition wherein said section means are disposed in a substantially planar disposition;

(d) each of said section means further including a center support means having opposed and parallel spaced sides, a first plate means hingedly connected to one of said sides of said center support means by second hinge means, a second plate means hingedly connected to a side of said first plate means opposite to the one hingedly connected to said center support means by third hinge means, a third plate means hingedly connected to the other of said sides of said center support by fourth hinge means and a fourth plate means hingedly connected to a side of said third plate means opposite to the one hingedly connected to said center support means by a fifth hinge means;

(e) said center support means of adjacent ones of said section means being hingedly connected to each other, said first hinge means, and said first, second, third and fourth plate means being hingedly connected to adjacently disposed respective ones of said first, second, third and fourth ones of said plate means of adjacent section means by said second, third, fourth and fifth hinge means and substantially along co-linear hinge lines each extending said predetermined longitudinal extent;

(f) said second and fourth hinge means permitting pivoting of aligned first and third plate means, in said unfolded condition of the structure, into positions substantially perpendicular to said center support means and said third and fifth hinge means permitting pivoting of said aligned second and fourth plate means, in said unfolded condition of the structure, into positions substantially perpendicular to said first and third plate means to thus rigidize the structure;

(g) said second, third, fourth and fifth hinge means permitting pivoting of said first, second, third and fourth plate means into a substantially planar configuration with said center support means to permit folding of the structure into said relatively compact package.

2. The structure of claim 1 including spring means urging the structure, when in said unfolded condition, into said rigidized condition.

3. The structure of claim 2, wherein said spring means includes at least a first spring having one end connected to a center support means and another end connected to a second plate means and a second spring having one end connected to a center support means and another end connected to a fourth plate means.

4. The structure of claim 3, wherein said center support means, said second plate means and said fourth plate means all are hingedly connected together into a section means.

5. The structure of claim 1, wherein each of said center support means includes a cross-bar spanning said sides thereof, said cross-bars of adjacently disposed section means being spaced one from the other.

6. The structure of claim 5, wherein said space between adjacent cross-bars is of a size and configuration such that if the structure is disposed as a ladder said spaces permit climbing thereof.

7. The structure of claim 1, wherein said section means cooperate, in the rigidized condition of the structure to form a ladder.

8. The structure of claim 1, wherein said section means cooperate, in the rigidized condition of the structure to form a space spanning structure in the form of a bridge.

9. The structure of claim 1, wherein all of said first, second, third and fourth plate means are identical in construction.

10. The structure of claim 9, wherein all of said first, second, third and fourth plate means include a plurality of spaced hinge fingers extending out from each of the sides of each of said plate means and of a size and configuration to cooperate and mate with hinge fingers of adjacent ones of said plate means, and hinge pins connecting mating ones of said hinge fingers to form said respective hinge means.

11. The structure of claim 10, wherein said hinge pins connecting adjacent ones of said sections are disposed to pivot about hinge axes alternately disposed co-planar with a top surface of said section means or a bottom surface of a section means.

12. The structure of claim 11, wherein said hinge pins connecting adjacent ones of said plate means and said hinge pins connecting said plate means and said center support means, within a section means, are disposed to pivot about hinge axes disposed midway between upper and lower surfaces thereof.

* * * * *